US006279444B1

(12) United States Patent
Kellner et al.

(10) Patent No.: US 6,279,444 B1
(45) Date of Patent: Aug. 28, 2001

(54) CUTTING TOOL, ESPECIALLY PLANE BLADE HEAD OR PLANE BLADE SHAFT

(75) Inventors: Karl-Heinz Kellner, Aalen; Dieter Stein, Oberkochen, both of (DE)

(73) Assignee: Leitz GmbH & Co. KG, Oberkochem (DE)

( * ) Notice: Subject to any disclaimer, the term of this patent is extended or adjusted under 35 U.S.C. 154(b) by 0 days.

(21) Appl. No.: 09/424,538

(22) PCT Filed: Mar. 25, 1999

(86) PCT No.: PCT/DE99/00919

§ 371 Date: Mar. 9, 2000

§ 102(e) Date: Mar. 9, 2000

(87) PCT Pub. No.: WO99/48655

PCT Pub. Date: Sep. 30, 1999

(30) Foreign Application Priority Data

Mar. 25, 1998 (DE) ..... 198 13 084

(51) Int. Cl.[7] ..... B26D 1/62
(52) U.S. Cl. ..... 83/698.41; 83/663
(58) Field of Search ..... 83/663, 843, 840, 83/698.31, 698.41

(56) References Cited

U.S. PATENT DOCUMENTS

| | | | | |
|---|---|---|---|---|
| 3,989,077 | * | 11/1976 | Humbert | 83/698.31 |
| 4,068,694 | * | 1/1978 | Schmidt et al. | 83/698.31 |
| 4,604,931 | * | 8/1986 | Bastian et al. | 83/698.31 |
| 4,848,202 | * | 7/1989 | Crampton | 83/698.31 |
| 5,086,683 | * | 2/1992 | Steidinger | 83/698.31 |
| 5,224,408 | * | 7/1993 | Steidinger | 83/698.31 |
| 5,282,409 | * | 2/1994 | Rojas | 83/698.31 |
| 5,357,836 | * | 10/1994 | Stromberg et al. | 83/698.31 |
| 5,740,714 | * | 4/1998 | Martin | 83/698.31 |
| 5,791,219 | * | 8/1998 | Ochsner | 83/663 |
| 6,109,158 | * | 8/2000 | Koelsch | 83/698.31 |

FOREIGN PATENT DOCUMENTS

| | | |
|---|---|---|
| 1195934 | 10/1957 | (DE) . |
| 7234252 | 9/1972 | (DE) . |
| 2559406 | 3/1977 | (DE) . |
| 0428996 | 7/1996 | (EP) . |

* cited by examiner

*Primary Examiner*—Rinaldi I. Rada
*Assistant Examiner*—Kim Ngo C Tran
(74) *Attorney, Agent, or Firm*—McGuireWoods, LLP

(57) ABSTRACT

A cutting tool, especially a plane blade head or plane blade shaft, includes a supporting body (1) having at least one recess (3) which is open radially to the outside, a wedge shaped clamping jaw (4) housed in the recess (3) and a blade (6) which can be fixed in its seat by means of the clamping jaw (4). For positioning the blade (6) the clamping jaw (4) is pretensioned by a compression spring (13), and for removing the blade (6) the clamping jaw (4) can be displaced radially inwards against the force of the compression spring (13), whereby the clamping jaw (4) automatically self-locks in its radial inner position. The arrangement permits the automatic self-locking of the clamping jaw (4) by providing for a spring-loaded bolt (7) which engages a recess (22) provided for in the clamping jaw (4).

16 Claims, 5 Drawing Sheets

CUTTING TOOL, ESPECIALLY PLANE BLADE HEAD OR PLANE BLADE SHAFT

Figure 1:
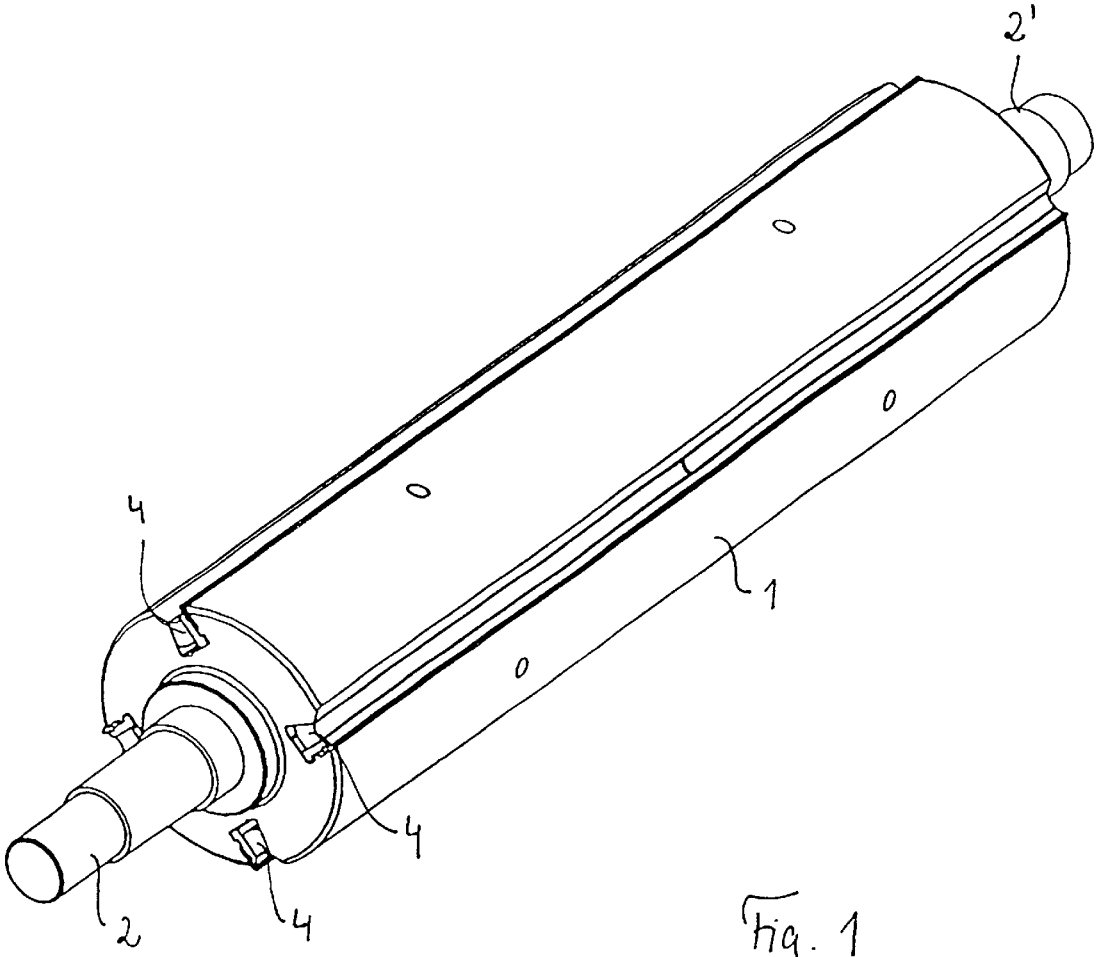

The invention relates to a cutting tool, in particular a planing cutter head or planing cutter spindle, with a supporting body having at least one receptacle open radially outward, a wedge-shaped clamping jaw arranged in the receptacle, and a cutter able to be gripped in its seat by means of the clamping jaw, in connection with which the clamping jaw is prestressed by a pressure spring to position the cutter and can be slid radially inward against the force of the pressure spring to remove the cutter, and the clamping jaw can be locked in its radially inward position.

Such a cutting tool is known from EP 0 428 996 B1, for example. To lock the clamping jaw, a recess is incorporated in the receptacle in the supporting body on the side opposite the cutter seat; the clamping jaw can snap into this recess with a projection provided on it. When changing cutters, the clamping jaw must be pressed radially inward and tilted slightly in its inward position so that the projection on the supporting body can engage the recess in the supporting body and so that the clamping jaw can be locked.

To release the clamping jaw, it must first be lowered a bit more and then tipped back in the other direction, in order for the projection to disengage the recess in the supporting body. The combined pressure and tipping motion a certain manual skill is required when changing cutters.

A cutter spindle is known from DE-AS 11 95 934. The cutter is screwed down with a cutter holder that can be attached form-fitting in a recess in the supporting body. The cutter holder is impacted from the rear by the spring-loaded clamping jaw, thereby positioning the cutter on its trajectory circle. If the cutter spindle is rotated, as a result of the centrifugal force acting on the clamping jaw the clamping jaw moves radially outward in the receptacle and solidly clamps the cutter via the cutter holder. To change the cutter, the operator must press the clamping jaw radially inward against the force of the spring and hold it in this position until the cutter holder can be released from the form closure and removed together with the cutter. The clamping jaw must then be slowly released in such a way that it is pushed radially outward by the pressure spring. If the clamping jaw is let go too quickly, the spring springs out suddenly and flings the clamping jaw out of the receptacle. In this case there is considerable risk of injury for the operating personnel. Since the clamping jaw can also fall out of the receptacle—and then possibly could not be found—the operator will remove the clamping jaw when changing the cutter, as a rule. Consequently, handling the cutting tool is quite complicated.

Similar cutting tools are also known from the German utility model no. 72 34 252 and [patent] DE 25 59 406 A1. In the case of the cutting tool according to the latter publication, the cutter is connected via a spring/groove connection with a cutter holder that protrudes into the groove-shaped receptacle; the spring-loaded clamping jaw acts against the rear of the cutter holder. The cutter holder is likewise stressed by a pressure spring. The cutter is positioned by the prestressed cutter holder and the prestressed clamping jaw. If the cutter spindle is rotated, as a result of the centrifugal force acting on the clamping jaw the clamping jaw moves radially outward in the receptacle and solidly clamps the cutter via the cutter holder.

To remove the cutter, the clamping jaw must be pressed back radially inward against the spring force until its locking with the cutter holder is released, whereby the cutter holder with the cutter is then pushed further radially outward by the pressure spring acting on it, and the cutter can then be removed from the cutter holder. If the clamping jaw is relieved, it springs back in the receptacle and hits against the cutter holder in the removal position. If the new cutter is to be positioned, the cutter holder must be pressed back not only against the force of its pressure spring but additionally against the frictional force acting on it from the clamping jaw. If the frictional force is too great, the clamping jaw must again be pressed radially inward and held there until the cutter holder has been brought into its position; this in part causes very complicated handling of the cutting tool.

Starting with this set of problems, the cutting tool described in the beginning is to be improved in such a way that to change the cutter, the locking of the clamping jaw in its radially inward position is made easier.

As a solution, the generic cutting tool is characterized in that to automatically lock the clamping jaw, a spring-loaded bolt is provided that engages a recess provided in the clamping jaw. With this design, it is also possible, as previously, to slide the clamping jaw radially inward into the receptacle against the force of the pressure spring to remove the cutter. If slid far enough, the clamping jaw snaps tight. The cutter can then be removed and also reinserted without the clamping jaw having to be pressed in or tipped again by the operator in the process.

The bolt is preferably arranged essentially tangentially in the supporting body and is guided in a bore in the supporting body, ending in the receptacle. If the clamping jaw is pressed far enough into the receptacle, the bolt snaps into the recess preferably designed as a bore hole, whereby a secure attachment and locking of the clamping jaw is brought about.

To release the locking of the clamping jaw, a bolt hole is preferably provided in the supporting body that is aligned with the bolt hole of the clamping jaw and ends in the receptacle. A tool (mandrel) can then be inserted into this bore hole and the bolt can be pressed back into its guide bore. The clamping jaw then springs back a little and blocks the bolt in its guide bore. After the tool is pulled out, the clamping jaw springs further radially outward and then positions the cutter.

If the clamping jaw is designed with a symmetric cross-section, it is effectively prevented from being accidentally inserted the wrong way into the receptacle, thereby increasing safety during operation of the cutting tool.

A cutter holder is preferably arranged between the clamping jaw and the cutter; in particular it is preferably mounted pivoting in the receptacle. In the radially inward position of the clamping jaw, the cutter holder then swings back, thereby simplifying the removal of the cutter. At the same time, the insertion of a new cutter is also made easier. If the clamping jaw springs back, the cutter holder swings against the cutter and the cutter is positioned. In order to set the precise positioning, the cutter can be connected form-fitting with the cutter holder via a spring/groove connection. The cutter holder is prestressed by a pressure spring resting against the bottom of the receptacle in such a way that it presses the cutter holder radially outward after the clamping jaw is released, until the cutter holder is pressed radially outward against a stop provided in the receptacle. In this way, the diameter of the cutter's trajectory circle is set precisely.

The cutter holder is then prestressed via a bolt that has a stud projecting radially outward and against which the clamping jaw hits, and when the latter is locked, it pushes the bolt far enough radially inward that the cutter holder is relieved of force.

To secure the cutter axially, at least one screw, able to be screwed axially into the supporting body, can be provided.

This design prevents the cutter from falling axially out of the cutter spindle when changing the cutter on cutting tools that are vertically inserted into the machine.

To secure the cutter holder axially, a bushing can be inserted into the bore hole in the supporting body; with its end facing the receptacle, it engages a recess in the cutter holder. In this way, the cutter holder is secured axially.

If, in the clamping jaw, a groove is provided that ends in the recess and can be engaged by the bolt when the clamping jaw takes its radially outward position, the clamping jaw is also secured against axial displacement.

Figure 3:
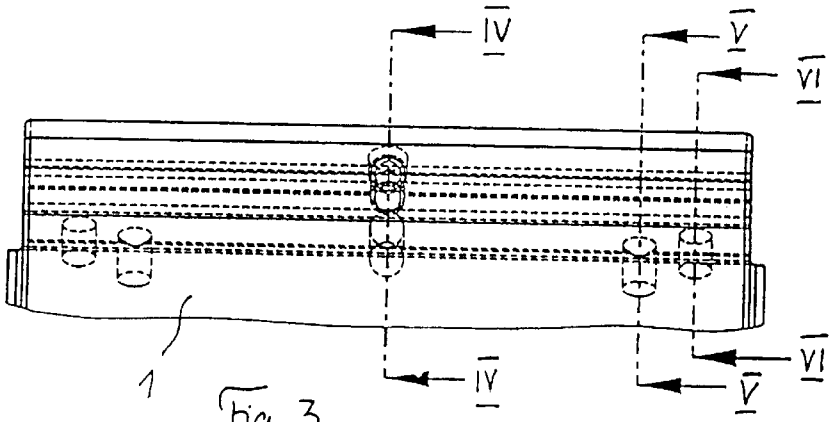
Figure 2:
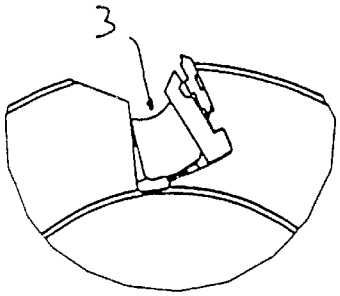
Figure 6:
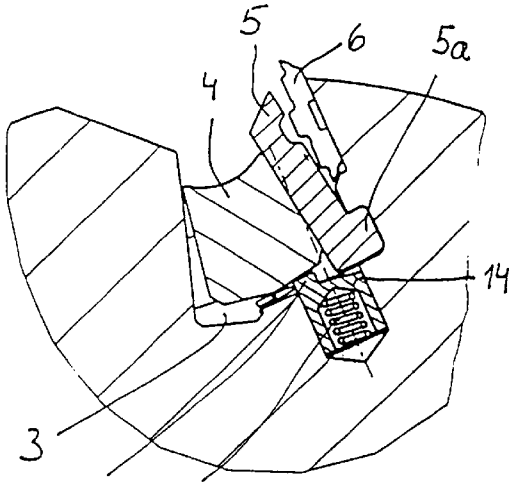
Figure 5:
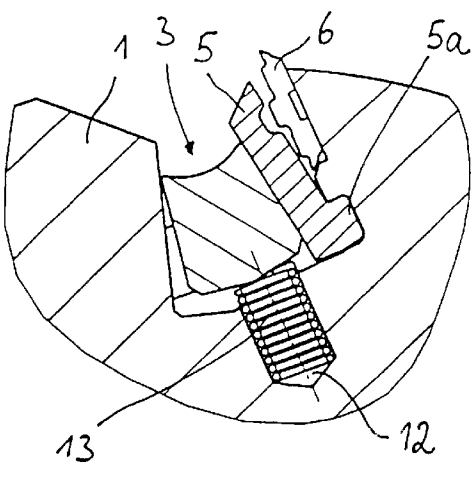
Figure 4:
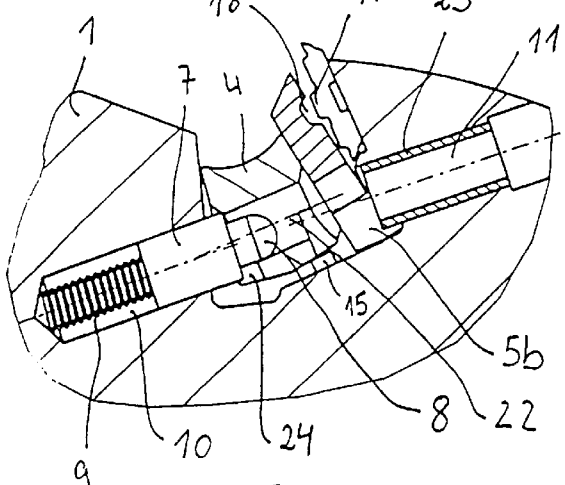
Figure 7:
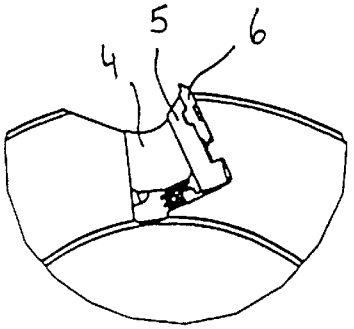
Figure 8:
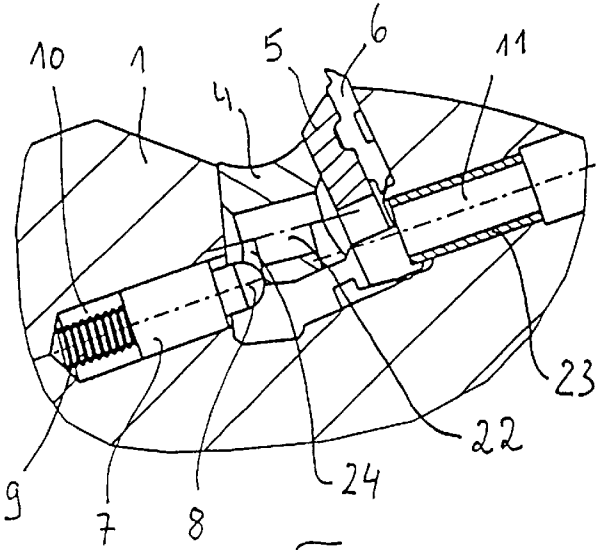
Figure 9:
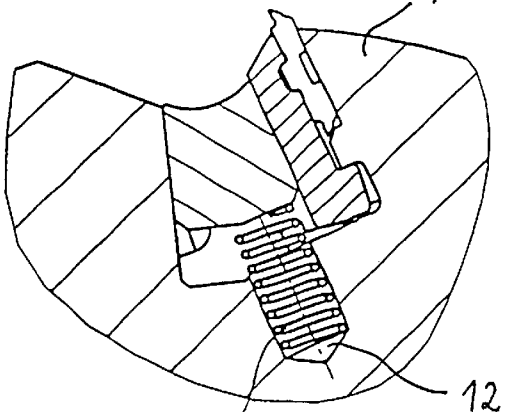
Figure 10:
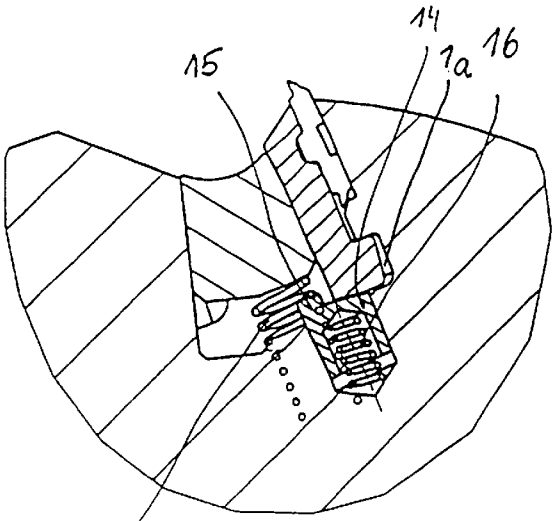
Figure 11:
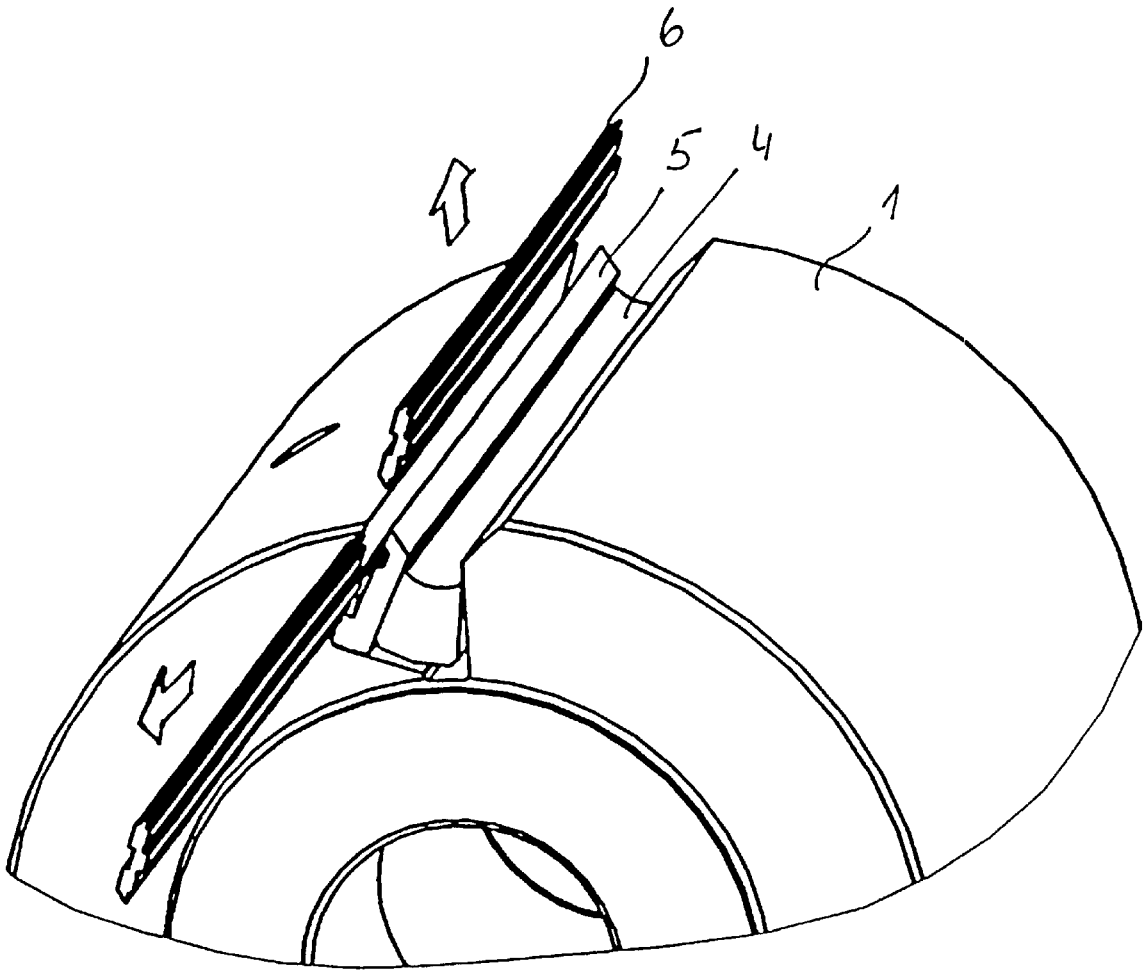
Figure 12:
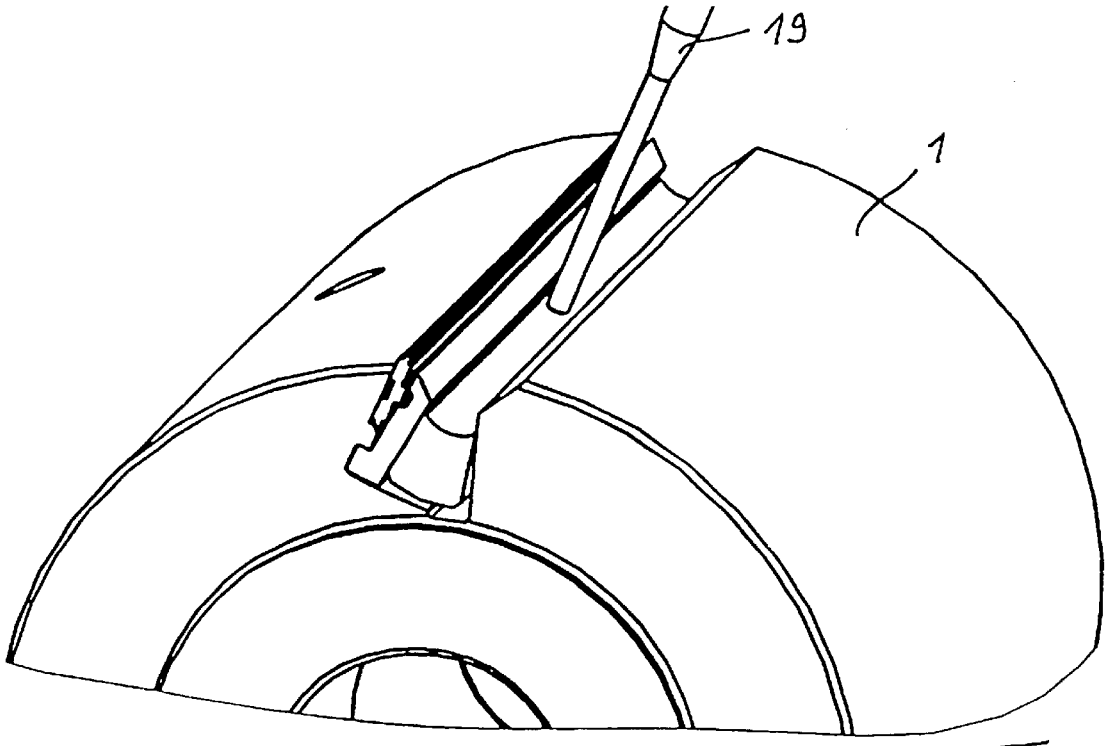

An example of execution of the invention is described in greater detail with the help of drawings. The following are shown:

FIG. 1 a cutting tool in perspective view;

FIG. 2 the cutting tool in a partial side view in the cutter's changing position;

FIG. 3 the top view of the cutting tool;

FIG. 4 the cutting tool in the cutter's changing position in a partial section along line IV—IV according to FIG. 3;

FIG. 5 the cutting tool in the cutter's changing position in a partial section along line V—V according to FIG. 3;

FIG. 6 the cutting tool in the cutter's changing position in a partial section along line VI—VI according to FIG. 3;

FIG. 7 the cutting tool in a partial side view in the cutter's clamped position;

FIG. 8 the illustration according to FIG. 4 with the cutter positioned and clamped;

FIG. 9 the illustration according to FIG. 5 with the cutter positioned and clamped;

FIG. 10 the illustration according to FIG. 6 with the cutter positioned and clamped;

FIG. 11 a partial view in perspective of a cutting tool;

FIG. 12 a partial view in perspective of a cutting tool; and

Figure 13:
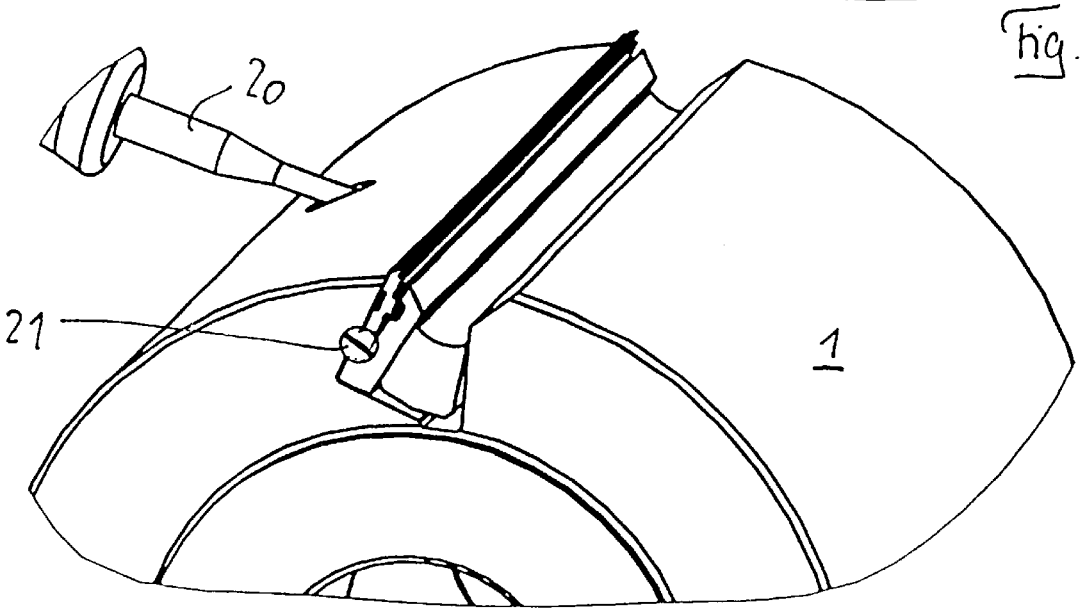

FIG. 13 a partial view in perspective of a cutting tool.

The cutter spindle is provided at its end with two axial pegs 2, 2' via which it is mounted rotating in a machine not illustrated in greater detail here. It consists of the supporting body 1 and, for example, four receptacles 3 regularly spread over the circumference. The receptacles 3 are groove-shaped recesses in the supporting body 1. Arranged in the receptacles are the clamping jaw 4 stressed via the pressure spring 13, the cutter holder 5 stressed by the pressure spring 16, and the cutter 6, respectively, with the clamping jaw 4 and the cutter holder 5 situated before the cutter in the direction of rotation. The clamping jaw 4, the cutter holder 5 and the cutter 6 are designed as oblong components. On its radially inward side, the cutter holder 5 is provided with a projection 5*a* running at right angles and engaging an undercut provided accordingly in the receptacle 3. In the area of its radially outward end, the cutter holder 5 is provided with a groove 18 running its entire length and engaged by a projection/spring 17 provided on the front side of the cutter 6 and also running its entire length. The back of the cutter 6 is designed flat and rests against the supporting body 1.

In the wedge-shaped clamping jaw 4 designed with symmetric cross-section, a bore hole 22 is provided that runs essentially tangentially. In the supporting body 1, a bore 10 is placed that ends in the lower area of the receptacle 3. Guided in this bore 10 is a bolt 7 that is stressed by a pressure spring 9. On the side opposite the bore 10, a bore hole 11 aligned with the bore 11 is placed in the supporting body 1. At the level of the bore hole 11, the cutter holder 5 is provided with a recess 5*b* that is open radially inward (FIG. 4). If the clamping jaw 4 is pressed radially inward with a tool 19, for example, against the force of the spring 13 that rests at the bottom of the receptacle 3 or in a recess or bore 12 extending radially further inward from there, the bore hole 22 comes into alignment with the bore 10, in such a way that the bolt 7 snaps with its spherical head into the bore 22 and locks the clamping jaw 4 in its radially inward position. In the process, the clamping jaw 4 presses on the projection 15 of the hollowed bolt 14 and presses it likewise radially inward against the force of the pressure spring 16 in such a way that the cutter holder 5 is relieved and swings out of place. In this position shown in FIGS. 4 through 8, the cutter 6 can be removed axially or radially (cf. FIG. 11).

In order to clamp the cutter again, the locking of the clamping jaw 4 must be released. For this purpose, a tool 20 is inserted into the bore 11 and with it, the bolt 7 is pushed into the guide bore 10 against the force of the spring 9. As can be seen in FIG. 4, the axis of the bore hole 22 in the clamping jaw 4 does not run parallel to the axes of the bores 10 and 11. If the head 8 of the bolt 7 is disengaged from the bore 22, the clamping jaw 4 is swung via the tool 20 far enough for the axis of the bore hole 22 to run parallel to the axis of the bore hole 11, whereby the head 8 of the bolt 7 is blocked in its end position via the clamping jaw 4 and runs up against it. After the tool 20 is removed, the clamping jaw 4 is pushed radially outward via the pressure spring 13. At the same time, the bolt 14 pushes the cutter holder 5 far enough outward for the projection 5*a* to come to rest in the undercut 1*a* (FIG. 10). A defined stop is thus formed in such a way that when the cutter holder 5 is swung, the spring/groove connection 17, 18 between the cutter 6 and the cutter holder 5 is set and the cutter 6 is positioned in its trajectory circle. When the cutting tool starts running, the centrifugal force acting on the clamping jaw 4 pulls its radially further outward and clamps the cutter 6 and the cutter holder plate 5.

To secure the cutter holder 5 against axial displacement, a bushing 23 is inserted into the bore hole 11; it engages the downward-opening recess of the cutter holder 5. To secure the clamping jaw 4 against axial displacement, a groove 24 is provided that ends in the bore hole 22 and is engaged by the bolt 7 with its head 8 (cf. FIG. 8).

The cutting tool can be installed horizontally as well as vertically. To prevent the cutter 6 from falling out axially when changing the cutter on a vertically inserted cutting tool, screws 21 that form a stop for the cutter 6 and the cutter holder 5 can be screwed axially into the supporting body 1 on both sides of the cutter (FIG. 13).

REFERENCE NUMBER LIST

1 supporting body
1*a* undercut
2 pins
3 receptacle
4 clamping jaw/wedge
5 cutter holder
5*a* projection
5*b* recess/groove
6 cutter
7 bolt
8 head
9 spring
10 bore
11 bore
12 bore/recess
13 spring
14 bolt
15 projection
16 spring/pressure spring
17 spring

18 groove
19 stud/tool
20 pin/tool
21 screw
22 bore hole/recess
23 bushing
24 groove

What is claimed is:

1. Cutting tool, comprising:

a supporting body having at least one receptacle open radially outward;

a clamping jaw arranged in the receptacle;

a cutter able to be gripped in said at least one receptacle by means of the clamping jaw;

a spring biased against said clamping jaw, whereby said spring biases said clamping jaw radially outward to a first position in said at least one receptacle where the cutter is firmly gripped into a cutting position in the at least one receptacle by said clamping jaw, and said clamping jaw being slidable radially inward in said at least one receptacle against the spring to a second position which allows removal of the cutter; and a spring-loaded bolt that engages a recess in the clamping jaw to lock said clamping jaw in said second position.

2. Cutting tool according to claim 1, wherein the spring loaded bolt is arranged essentially tangentially in the supporting body.

3. Cutting tool according to claim 1, wherein the spring loaded bolt is guided in a bore provided in the supporting body and ending in the receptacle.

4. Cutting tool according to claim 3 further comprising a bolt hole aligned with the bore and ending in the receptacle through which a tool acting on the spring loaded bolt can be inserted.

5. Cutting tool according to claim 1, wherein the recess is a bolt hole.

6. Cutting tool according to claim 1 wherein the spring loaded bolt has a spherical head.

7. Cutting tool according to claim 1 wherein the clamping jaw has a symmetric cross-section.

8. Cutting tool according to claim 1, further comprising a cutter holder positioned between the clamping jaw and the cutter.

9. Cutting tool according to claim 8, wherein the cutter holder is pivotably mounted in the at least one receptacle.

10. Cutting tool according to claim 8, wherein the cutter holder is prestressed by a pressure spring.

11. Cutting tool according to claim 10, wherein the prestress of the cutter holder is transferred via a bolt receiving the pressure spring with a stud projecting toward the clamping jaw and on which the clamping jaw acts in said second position in such a way that the cutter holder is relieved of the forced of the pressure spring.

12. Cutting tool according to claim 8, wherein the cutter is connected form-fitting with the cutter holder via a spring/groove connection.

13. Cutting tool according to claim 8 further comprising a bolt hole aligned with the bore, and a bushing able to be inserted into the bore hole which engages a recess in the cutter holder with its end facing the receptacle in order to axially secure the cutter holder.

14. Cutting tool according to claim 1 further comprising at least one screw that can be screwed axially into the supporting body to secure the cutter.

15. Cutting tool according to claim 1 further comprising a groove ending in the recess is provided in the clamping jaw, and the spring loaded bolt engages said groove to axially secure the clamping jaw.

16. Cutting tool according to claim 1 wherein said clamping jaw is wedge shaped and said at least one receptacle is wedge shaped.

* * * * *